US009493020B2

(12) United States Patent
Kayahara

(10) Patent No.: US 9,493,020 B2
(45) **Date of Patent: *Nov. 15, 2016**

(54) DOT RECORDING APPARATUS, DOT RECORDING METHOD, COMPUTER PROGRAM THEREFOR, AND METHOD OF MANUFACTURING RECORDING MEDIUM

(71) Applicant: SEIKO EPSON CORPORATION, Tokyo (JP)

(72) Inventor: Naoki Kayahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/828,847

(22) Filed: Aug. 18, 2015

(65) Prior Publication Data

US 2016/0129713 A1 May 12, 2016

(30) Foreign Application Priority Data

Nov. 10, 2014 (JP) ..... 2014-227760

(51) Int. Cl.
*B41J 29/38* (2006.01)
*B41J 29/393* (2006.01)

(52) U.S. Cl.
CPC ..... *B41J 29/393* (2013.01)

(58) Field of Classification Search
None
See application file for complete search history.

(56) References Cited

U.S. PATENT DOCUMENTS 5,633,663 A 5/1997 Matsubara et al.
5,992,962 A * 11/1999 Yen ..... B41J 2/2132 347/12
7,907,307 B2 3/2011 Yamazaki
7,948,652 B2 5/2011 Noguchi et al.
8,786,896 B2 * 7/2014 Marumoto ..... G06K 15/1874 358/1.2
2009/0073203 A1 3/2009 Takekoshi et al.
2015/0015626 A1 1/2015 Kayahara et al.

FOREIGN PATENT DOCUMENTS

JP 06-022106 A 1/1994
JP 2002-036515 A 2/2002
JP 2007-306550 A 11/2007
JP 2008-092191 A 4/2008
JP 2013-256003 A 12/2013
JP 2014-200971 A 10/2014
JP 2015-016671 A 1/2015

* cited by examiner

*Primary Examiner* — Erica Lin
*Assistant Examiner* — Tracey McMillion
(74) *Attorney, Agent, or Firm* — Global IP Counselors, LLP

(57) ABSTRACT

A dot recording apparatus forms dots on a recording medium while relatively moving a recording head that includes a plurality of nozzles and the recording medium in a main scanning direction. The dot recording apparatus performs multi-pass recording in which dot recording on a main scanning line is completed by a plurality of main scanning passes. In dot recording in each main scanning pass, the dot recording is performed with a super cell region as a unit, the super cell region including one or more unit super cells formed as a dot group of one mass by some of the plurality of nozzles. In the same main scanning pass, the number of unit super cells recorded by m nozzles at an end portion of the recording head is smaller than the number of unit super cells recorded by m nozzles at a center portion of the recording head.

10 Claims, 13 Drawing Sheets

| | THE NUMBER OF UC1 |
|---|---|
| S1 | 11 |
| S2 | 12 |
| S3 | 12 |
| S4 | 12.5 |
| S5 | 13.5 |
| S6 | 13.5 |
| S7 | 14 |
| S8 | 15 |
| S9 | 16 |
| S10 | 18 |
| S11 | 18 |
| S12 | 8 |
| S13 | 8 |
| S14 | 8 |
| S15 | 7 |
| S16 | 6 |
| S17 | 7 |
| S18 | 5 |
| S19 | 5 |
| S20 | 2 |
| S21 | 2 |

| | THE NUMBER OF UC2 |
|---|---|
| S1 | 11 |
| S2 | 12 |
| S3 | 12 |
| S4 | 12.5 |
| S5 | 13.5 |
| S6 | 13.5 |
| S7 | 14 |
| S8 | 15 |
| S9 | 16 |
| S10 | 18 |
| S11 | 18 |
| S12 | 8 |
| S13 | 8 |
| S14 | 8 |
| S15 | 7 |
| S16 | 6 |
| S17 | 7 |
| S18 | 5 |
| S19 | 5 |
| S20 | 2 |
| S21 | 2 |

● : DOT OF UC1
(RECORDING IS PERFORMED BY ODD-NUMBERED PASS)

○ : DOT OF UC2
(RECORDING IS PERFORMED BY EVEN-NUMBERED PASS)

| | THE NUMBER OF UC1 | THE NUMBER OF UC2 |
|---|---|---|
| S1 | 0 | 4 |
| S2 | 1 | 3 |
| S3 | 2 | 2 |
| S4 | 3 | 1 |
| S5 | 4 | 0 |
| S6 | 3 | 1 |
| S7 | 2 | 2 |
| S8 | 1 | 3 |
| S9 | 0 | 4 |
| S10 | 1 | 3 |
| S11 | 2 | 2 |
| S12 | 3 | 1 |
| S13 | 4 | 0 |

| | THE NUMBER OF UC1 | THE NUMBER OF UC2 |
|---|---|---|
| S1 | 0 | 3 |
| S2 | 1 | 2 |
| S3 | 2 | 1 |
| S4 | 3 | 0 |
| S5 | 2 | 1 |
| S6 | 1 | 2 |
| S7 | 0 | 3 |
| S8 | 1 | 2 |
| S9 | 2 | 1 |
| S10 | 3 | 0 |

| | THE NUMBER OF UC1 | THE NUMBER OF UC2 |
|---|---|---|
| S1 | 0 | 4 |
| S2 | 1 | 3 |
| S3 | 2 | 2 |
| S4 | 3 | 1 |
| S5 | 4 | 0 |
| S6 | 3 | 1 |
| S7 | 2 | 2 |
| S8 | 1 | 3 |
| S9 | 0 | 4 |
| S10 | 1 | 3 |
| S11 | 2 | 2 |
| S12 | 3 | 1 |
| S13 | 4 | 0 |

DOT RECORDING APPARATUS, DOT RECORDING METHOD, COMPUTER PROGRAM THEREFOR, AND METHOD OF MANUFACTURING RECORDING MEDIUM

CROSS-REFERENCE TO RELATED APPLICATIONS

This application claims priority to Japanese Patent Application No. 2014-227760 filed on Nov. 10, 2014. The entire disclosure of Japanese Patent Application No. 2014-227760 is hereby incorporated herein by reference.

BACKGROUND

1. Technical Field

The present invention relates to a dot recording apparatus, a dot recording method, a computer program therefor, and a method of manufacturing a recording medium.

2. Related Art

A printer that reciprocates a plurality of recording heads ejecting different colors of ink with respect to a recording material and performs printing by performing main scanning during the forward movement and backward movement thereof has been known as a dot recording apparatus (for example, JP-A-6-22106). In the printer, pixel groups each of which is constituted by m×n pixels are arrayed within a printable region through one main scanning operation so as not to be adjacent to each other. In addition, recording is completed by performing main scanning plural times using a plurality of thinning patterns having an arrangement that is mutually complementary.

However, in the above-mentioned printer of the related art, each of the pixel groups has a rectangular shape, and the boundary line thereof is constituted by a side parallel to a main scanning direction and a side parallel to a sub-scanning direction. Accordingly, an elongated boundary line extending in the main scanning direction and an elongated boundary line extending in the sub-scanning direction are formed by a set of boundary lines of the adjacent pixel groups. For this reason, there is a tendency for banding (image quality deterioration region) to be generated along the elongated boundary lines, which results in the problem of being conspicuousness. Such a problem is not limited to the printer, and is also common to dot recording apparatuses that record dots on a recording medium (dot recording medium).

SUMMARY

The invention can be realized in the following forms or application examples.

(1) According to an aspect of the invention, a dot recording apparatus is provided. The dot recording apparatus includes a recording head that includes a plurality of nozzles; a main scanning driving mechanism that performs a main scanning pass for forming dots on a recording medium while relatively moving the recording head and the recording medium in a main scanning direction; a sub-scanning driving mechanism that performs sub-scanning for relatively moving the recording medium and the recording head in a sub-scanning direction that intersects the main scanning direction; and a control unit. The control unit performs multi-pass recording in which dot recording on a main scanning line is completed by N main scanning passes (N is a predetermined integer of 2 or greater). In dot recording in each main scanning pass, the dot recording is performed with a super cell region, having a boundary line portion which is not parallel to either the main scanning direction or the sub-scanning direction in at least a portion of a boundary line between the super cell region and another super cell region, as a unit, the super cell region including one or more unit super cells formed as a dot group of one mass by some of the plurality of nozzles. In the same main scanning pass, the number of unit super cells recorded by m nozzles (m is an integer of 2 or greater) at an end portion of the recording head is smaller than the number of unit super cells recorded by m nozzles at a center portion of the recording head. According to the dot recording apparatus of this aspect, at least a portion of the boundary line of each of the individual super cell regions has a boundary line portion which is not parallel to either the main scanning direction or the sub-scanning direction, and thus it is possible to make banding less likely to be conspicuous, as compared to a case where the boundary line is constituted by only a boundary line parallel to the main scanning direction and a boundary line parallel to the sub-scanning direction. In addition, in the same main scanning pass, since the number of unit super cells recorded by m nozzles (m is an integer of 2 or greater) at the end portion of the recording head is smaller than the number of unit super cells recorded by m nozzles at the center portion of the recording head, it is possible to reduce the number of boundaries of the super cell regions as compared to a case where the numbers of unit super cells recorded by m nozzles are equal to each other over the whole length of the recording head, and to make a joint stripe less likely to be conspicuous.

(2) In the dot recording apparatus of the aspect, the unit super cell may have the same polygonal shape. According to the dot recording apparatus of this aspect, it is possible to reduce the size of the memory for specifying the unit super cell and a connection super cell.

(3) In the dot recording apparatus of the aspect, in dot recording in each main scanning pass, some of the plurality of unit super cells recorded in the same main scanning pass may be connected to other unit super cells recorded in the same main scanning pass to thereby generate a connection super cell. The super cell region may be either the unit super cell or the connection super cell. According to this aspect, it is possible to reduce boundaries of super cell regions recorded by different passes and to make a joint stripe less likely to be conspicuous.

(4) In the dot recording apparatus of the aspect, the super cell regions may include a first super cell region and a second super cell region that overlap each other at mutual boundaries. According to the dot recording apparatus of this aspect, two super cell regions overlap each other, and thus it is possible to make banding less likely to be conspicuous.

(5) In the dot recording apparatus of the aspect, when the first super cell region is recorded by a first main scanning pass and the second super cell region is recorded by a second main scanning pass which is subsequent to the first main scanning pass, a ratio in charge of dot recording which is a ratio of the number of pixel positions at which dot recording is performed, as pixel positions belonging to the first super cell region, to the number of pixel positions at which dot recording is performed as pixel positions belonging to the second super cell region may be set to gradually change from the first super cell region toward the second super cell region, in an intermediate region in which the first super cell region and the second super cell region overlap each other. According to the dot recording apparatus of this aspect, gradation having a ratio in charge of dot recording is formed in the intermediate region in which the first and second super cell regions overlap each other, and thus it is possible to make banding or a joint stripe less likely to be conspicuous.

(6) In the dot recording apparatus of the aspect, when a boundary line of any of the individual super cell regions includes a portion which is parallel to either the main scanning direction or the sub-scanning direction, the parallel portion may appear intermittently without continuing on the recording medium. According to the dot recording apparatus of this aspect, the boundary line parallel to the main scanning direction or the sub-scanning direction appears intermittently, and thus it is possible to make banding or a joint stripe less likely to be conspicuous.

(7) In the dot recording apparatus of the aspect, a value of the N may be 4. According to the dot recording apparatus of this aspect, one super cell region can be formed by one unit super cell.

(8) In the dot recording apparatus of the aspect, the super cell regions may have the same shape. According to the dot recording apparatus of this aspect, the super cell region and the unit super cell have the same shape, and thus it is possible to reduce the size of a memory for specifying the unit super cell and the super cell region.

Meanwhile, the invention can be implemented in various forms. For example, the invention can be implemented in various forms such as a dot recording method, a computer program for creating raster data for executing dot recording, a recording medium storing a computer program for creating raster data for executing dot recording, a method of manufacturing a recording medium, and a recording medium having dots recorded thereon, in addition to a dot recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
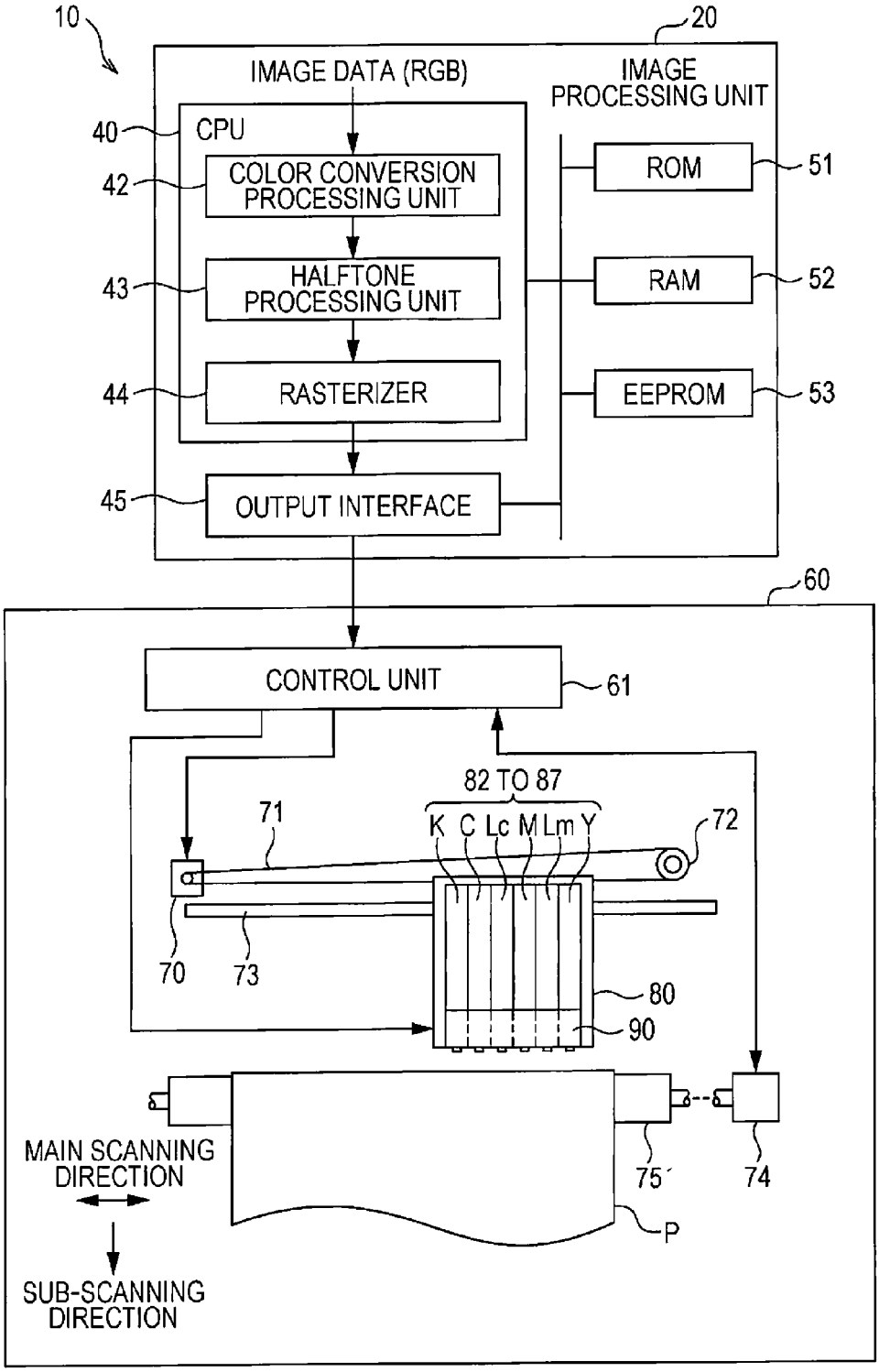
FIG. 1 is a diagram illustrating the configuration of a dot recording system.

FIG. 1 is a diagram illustrating the configuration of a dot recording system. A dot recording system 10 includes an image processing unit 20 and a dot recording unit 60. The image processing unit 20 generates printing data for the dot recording unit 60 from image data (for example, image data of RGB).

The image processing unit includes a CPU 40 (also referred to as "control unit 40"), a ROM 51, a RAM 52, an EEPROM 53, and an output interface 45. The CPU 40 has functions of a color conversion processing unit 42, a halftone processing unit 43, and a rasterizer 44. The functions are realized by a computer program. The color conversion processing unit 42 converts multi-gradation RGB data of an image into ink amount data indicating the amount of a plurality of colors of ink. The halftone processing unit 43 performs halftone processing on ink amount data to thereby create dot data indicating dot formation conditions for each pixel. The rasterizer 44 rearranges dot data generated by halftone processing to dot data used in individual main scanning performed by the dot recording unit 60. Hereinafter, dot data for each main scanning which is generated by the rasterizer 44 will be referred to as "raster data". Dot recording operations to be described in the following various embodiments are rasterizing operations (that is, operations expressed by raster data) which are realized by the rasterizer 44.

The dot recording unit 60, which is, for example, a serial type ink jet recording apparatus, includes a control unit 61, a carriage motor 70, a driving belt 71, a pulley 72, a sliding shaft 73, a sheet feed motor 74, a sheet feed roller 75, a carriage 80, ink cartridges 82 to 87, and a recording head 90.

The driving belt 71 is provided between the carriage motor 70 and the pulley 72. The carriage 80 is attached to the driving belt 71. The ink cartridges 82 to 87 respectively accommodating, for example, cyan ink (C), magenta ink (M), yellow ink (Y), black ink (K), light cyan ink (Lc), and light magenta ink (Lm) are mounted on the carriage 80. Meanwhile, various ink other than these examples can be used as ink. A nozzle array corresponding to ink of the above-mentioned colors is formed in the recording head 90 located on the lower side of the carriage 80. When the ink cartridges 82 to 87 are installed in the carriage BO from above, ink can be supplied to the recording head 90 from each of the cartridges. The sliding shaft 73 is disposed in parallel with the driving belt and penetrates the carriage 80.

When the carriage motor 70 drives the driving belt 71, the carriage 80 moves along the sliding shaft 73. This direction is referred to as a "main scanning direction". The carriage motor 70, the driving belt 71, and the sliding shaft 73 constitute a main scanning driving mechanism. The ink cartridges 82 to 87 and the recording head 90 also move in the main scanning direction in association with the movement of the carriage 80 in the main scanning direction. During the movement in the main scanning direction, ink is ejected onto a recording medium P (typically, a printing sheet) from a nozzle (to be described later) which is disposed at the recording head 90, and thus dot recording on the recording medium P is performed. In this manner, the movement of the recording head 90 in the main scanning direction and the ejection of ink are referred to as main scanning, and one main scanning is referred to as "main scanning pass" or is simply referred to as "pass".

The sheet feed roller 75 is connected to the sheet feed motor 74. During recording, the recording medium P is inserted on the sheet feed roller 75. When the carriage 80 moves up to an end portion in the main scanning direction, the control unit 61 rotates the sheet feed motor 74. Thereby, the sheet feed roller 75 also rotates to thereby move the recording medium P. A direction of a relative movement between the recording medium P and the recording head 90 is referred to as a "sub-scanning direction". The sheet feed motor 74 and the sheet feed roller 75 constitute a sub-scanning driving mechanism. The sub-scanning direction is a direction perpendicular (orthogonal) to the main scanning direction. However, the sub-scanning direction and the main scanning direction do not necessarily need to be perpendicular to each other, and may intersect each other. Meanwhile, in general, a main scanning operation and a sub-scanning operation are alternately performed. In addition, as a dot recording operation, at least one of a unidirectional recording operation of performing dot recording through only main scanning on a forward path and a bidirectional recording operation of performing dot recording through main scanning on both a forward path and a backward path can be performed. A direction of the main scanning on the forward path is merely opposite to the direction of the main scanning on the backward path, and thus a description will be given below without discriminating between a forward path and a backward path as long as it is not particularly required.

The image processing unit 20 may be formed integrally with the dot recording unit 60. In addition, the image processing unit 20 may be stored in a computer (not shown) and may be formed separately from the dot recording unit 60. In this case, the image processing unit 20 may be executed by a CPU as printer driver software (computer program) on a computer.

Figure 2:
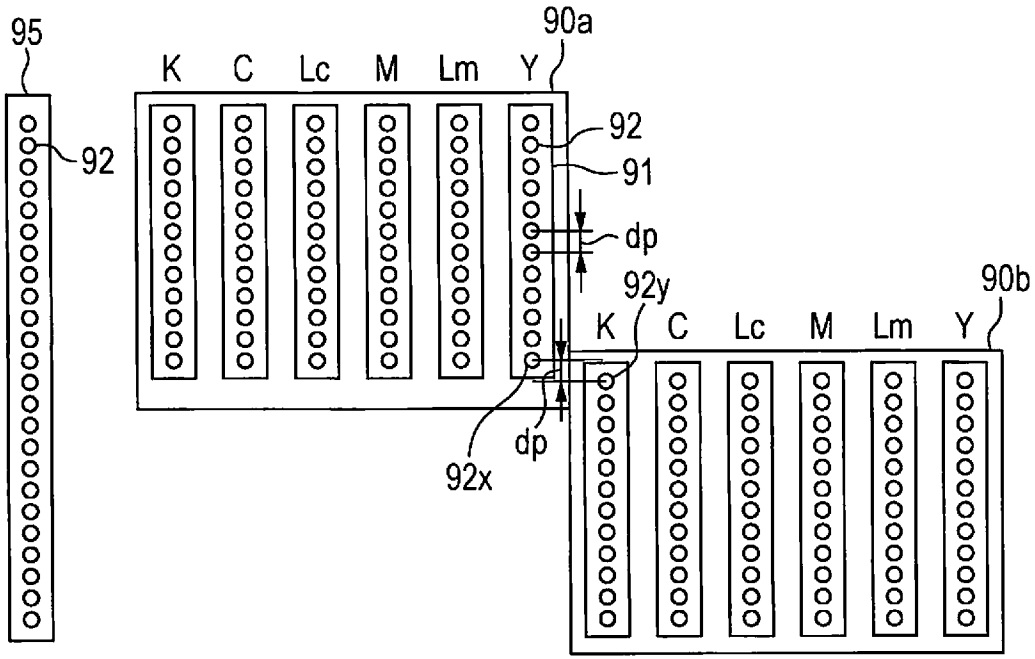
FIG. 2 is a diagram illustrating an example of the configuration of a nozzle array of a recording head.

FIG. 2 is a diagram illustrating an example of the configuration of a nozzle array of the recording head 90. Meanwhile, in FIG. 2, an illustration is given on the assumption that the number of recording heads 90 is two. However, the number of recording heads 90 may be one, or may be two or more. Each of two recording heads 90*a* and 90*b* includes a nozzle array 91 for each color. Each nozzle array 91 includes a plurality of nozzles 92 which are lined up in a sub-scanning direction at a fixed nozzle pitch dp. A nozzle 92*x* at an end portion of the nozzle array 91 of the first recording head 90*a* and a nozzle 92*y* at an end portion of the nozzle array 91 of the second recording head 90*b* are shifted in the sub-scanning direction by the same size as the nozzle pitch dp in the nozzle array 91. In this case, nozzle arrays of the two recording heads 90*a* and 90*b* for one color are equivalent to a nozzle array 95 (illustrated on the left side of FIG. 2) having the number of nozzles which is twice the number of nozzles of one recording head 90 for one color. In the following description, a method of performing dot recording for one color using the equivalent nozzle array 95 will be described. Meanwhile, in the first embodiment, the nozzle pitch dp is equivalent to a pixel pitch on a printing medium P. However, the nozzle pitch dp can also be set to an integral multiple of the pixel pitch on the printing medium P. In the latter case, so-called interlace recording (an operation of recording dots by a second pass and the subsequent passes so as to fill a gap between dots between main scanning lines recorded by a first pass) is performed. The nozzle pitch dp is a value equivalent to, for example, 720 dpi (0.035 mm).

Figure 3:
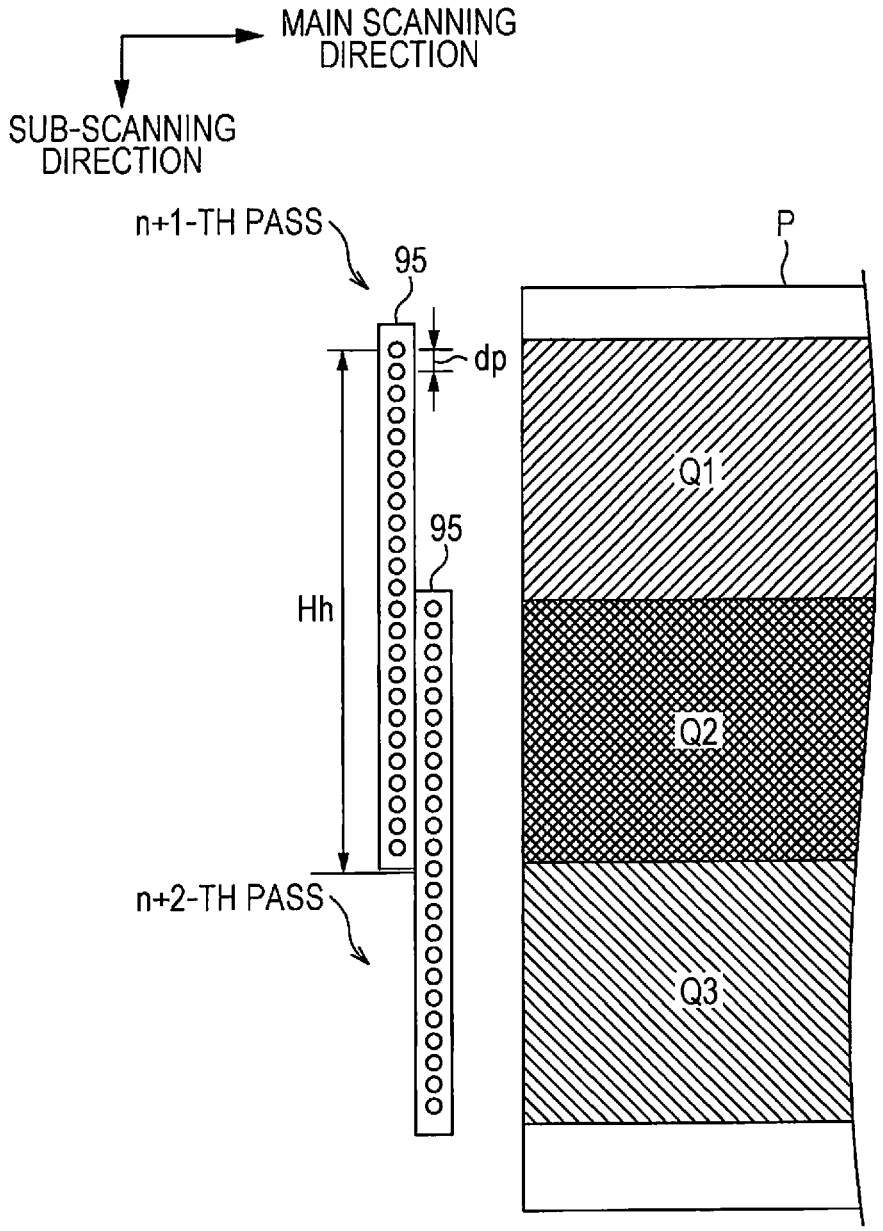
FIG. 3 is a diagram illustrating positions of nozzle arrays in two main scanning passes of dot recording and recording regions at the positions in a first embodiment.

FIG. 3 is a diagram illustrating the position of the nozzle array 95 in two main scanning passes of dot recording in the first embodiment, and a recording region at the position. In the following description, a case where dots are formed in all pixels of a recording medium P using ink of one color (for example, cyan ink) will be described as an example. In this specification, a dot recording operation of completing the formation of dots on individual main scanning lines by N main scanning passes (N is an integer of 2 or greater) will be referred to as "multi-pass recording". In the present embodiment, the number of passes N of multi-pass recording is 2. In a first (n+1-th pass (n is an integer of 0 or greater)) pass (1P) and a second (n+2-th pass) pass (2P), the position of the nozzle array 95 is shifted in the sub-scanning direction by a distance equivalent to half of a head height Hh. Here, "head height Hh" means a distance indicated by M×dp (M is the number of nozzles of the nozzle array 95, dp is a nozzle pitch).

In the n+1-th pass, dot recording is performed in some of all pixels of a region Q1 constituted by a main scanning line through which nozzles located at an upper half portion of the nozzle array 95 pass and some of all pixels of a region Q2 constituted by a main scanning line through which nozzles located at a lower half portion of the nozzle array 95 pass in the recording medium P. In the n+2-th pass, dot recording is performed in the remaining pixels in which no dot is formed in the n+1-th pass in all of the pixels of the region Q2 constituted by the main scanning line through which the nozzles located at the upper half portion of the nozzle array 95 pass and some of all pixels of a region Q3 constituted by a main scanning line through which the nozzles located at the lower half portion of the nozzle array 95 pass in the recording medium P. Accordingly, in the region Q2, the recording of 100% of the pixels is performed collectively in the n+1-th and n+2-th passes. Meanwhile, in an n+3-th pass, dots are formed in the remaining pixels of the region Q3 and some pixels of the next region Q4 (not shown). Here, a case where an image (solid image) having dots being formed in all of the pixels of the recording medium P is formed on the recording medium P is assumed. However, a real recording image (printing image) indicated by dot data includes pixels in which dots are actually formed on the recording medium P and pixels in which dots are not actually formed on the recording medium P. That is, whether or not to actually form dots in pixels of the recording medium P is determined by dot data generated by halftone processing. In this specification, the phrase "dot recording" used herein means "execution of the formation or non-formation of dots". In addition, the phrase "execution of dot recording" is not related to whether or not to actually form dots on the recording medium P, and is used as a phrase that means "taking charge of dot recording".

Figure 4:
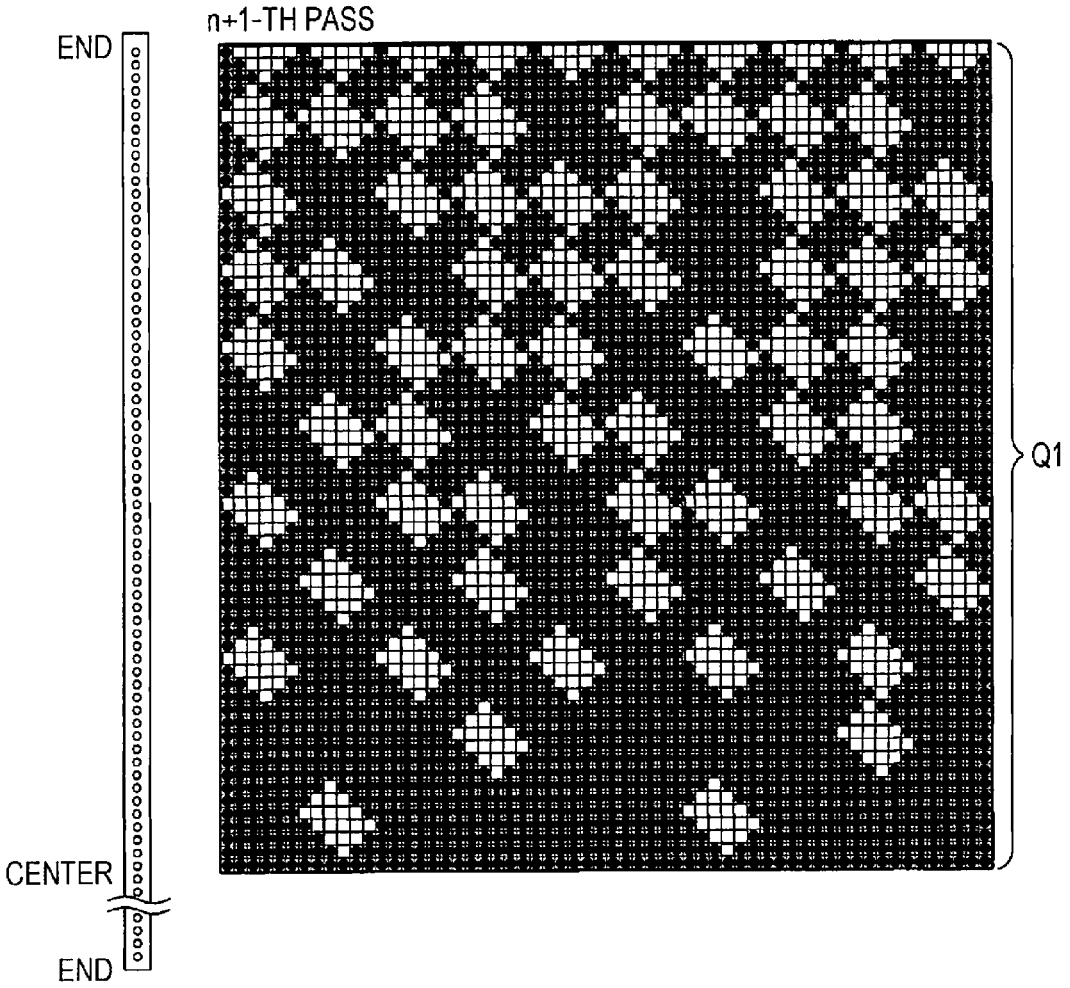
FIG. 4 is a diagram illustrating a dot recording state of a region Q1 of an n+1-th pass.

FIG. 4 is a diagram illustrating a dot recording state of the region Q1 (FIG. 3) in the n+1-th pass (n is an integer of 0 or greater). In the drawing, each small square is a region of one pixel, and a dot indicated by a black circle is a dot which is recorded in an n+1-th pass. A square in which a dot of a black circle is not recorded is a pixel which is recorded in an n-th pass. However, when a dot of the n-th pass is written, the dot is not likely to be observed, and thus the dot of the n-th pass is not illustrated in FIG. 4. An upper portion of FIG. 4 is a rear end portion side (upper end portion side of FIG. 3) of the nozzle array 95, and a lower portion of FIG. 4 is a center portion side of the nozzle array 95. The dots of the black circles in the upper portion (rear end portion side of the nozzle array 95) of FIG. 4 are less in number than those in the lower portion (center portion side of the nozzle array) of FIG. 4.

Figure 5:
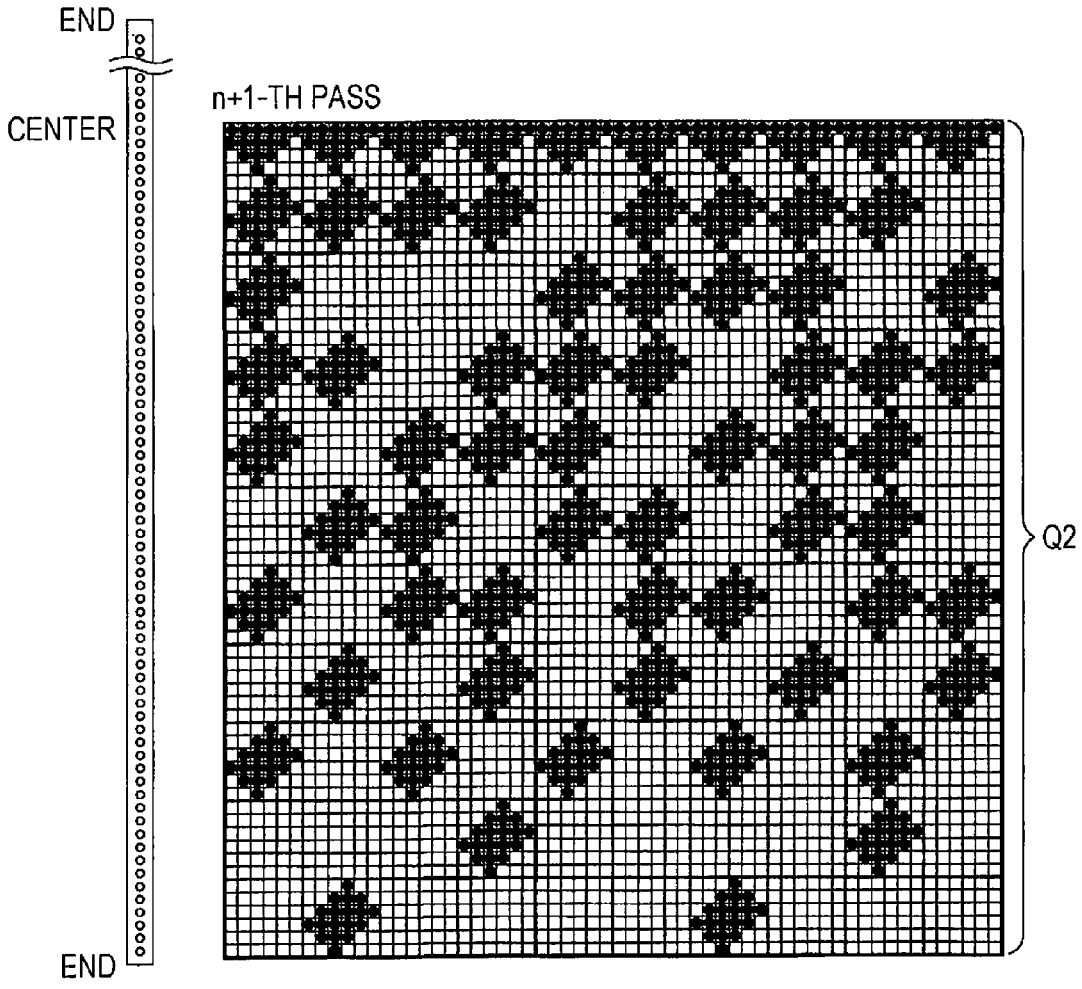
FIG. 5 is a diagram illustrating a dot recording state of a region Q2 of an n+1-th pass.

FIG. 5 is a diagram illustrating a dot recording state of the region Q2 (FIG. 3) in the n+1-th pass. Similarly to FIG. 4, a dot indicated by a black circle is a dot which is recorded in the n+1-th pass. A square in which a dot of a black circle is not recorded is a region which is recorded in the next n+2-th pass. In FIG. 5, the dot of the n+2-th pass is not likely to be observed, and thus is not illustrated in the drawing. An upper portion of FIG. 5 is a center portion side of the nozzle array 95, and a lower portion of FIG. 5 is a front end portion side (lower end side of FIG. 3) of the nozzle array 95. The dots of the black circles in the lower portion (end portion side of the nozzle array 95) of FIG. 5 are less than those in the upper portion (center portion side of the nozzle array) of FIG. 5. In addition, as seen from FIG. 5, the dots of the black circles form masses each of which has a substantially square shape, and the masses are disposed to be dispersed. The substantially square masses have substantially the same shape. In the present embodiment, a region of a substantially square mass, having the smallest size, which includes a plurality of dots is referred to as a unit super cell. Meanwhile, as described later, the unit super cell may not have a substantially square shape. In FIG. 5, the unit super cells are independently dispersed. However, in FIG. 4, two or more unit super cells are connected to each other to form a much larger mass of dots. Meanwhile, in the present embodiment, for convenience of illustration, although it is assumed that one mass of dots includes eighteen dots, one mass of dots may include more dots.

Figure 6:
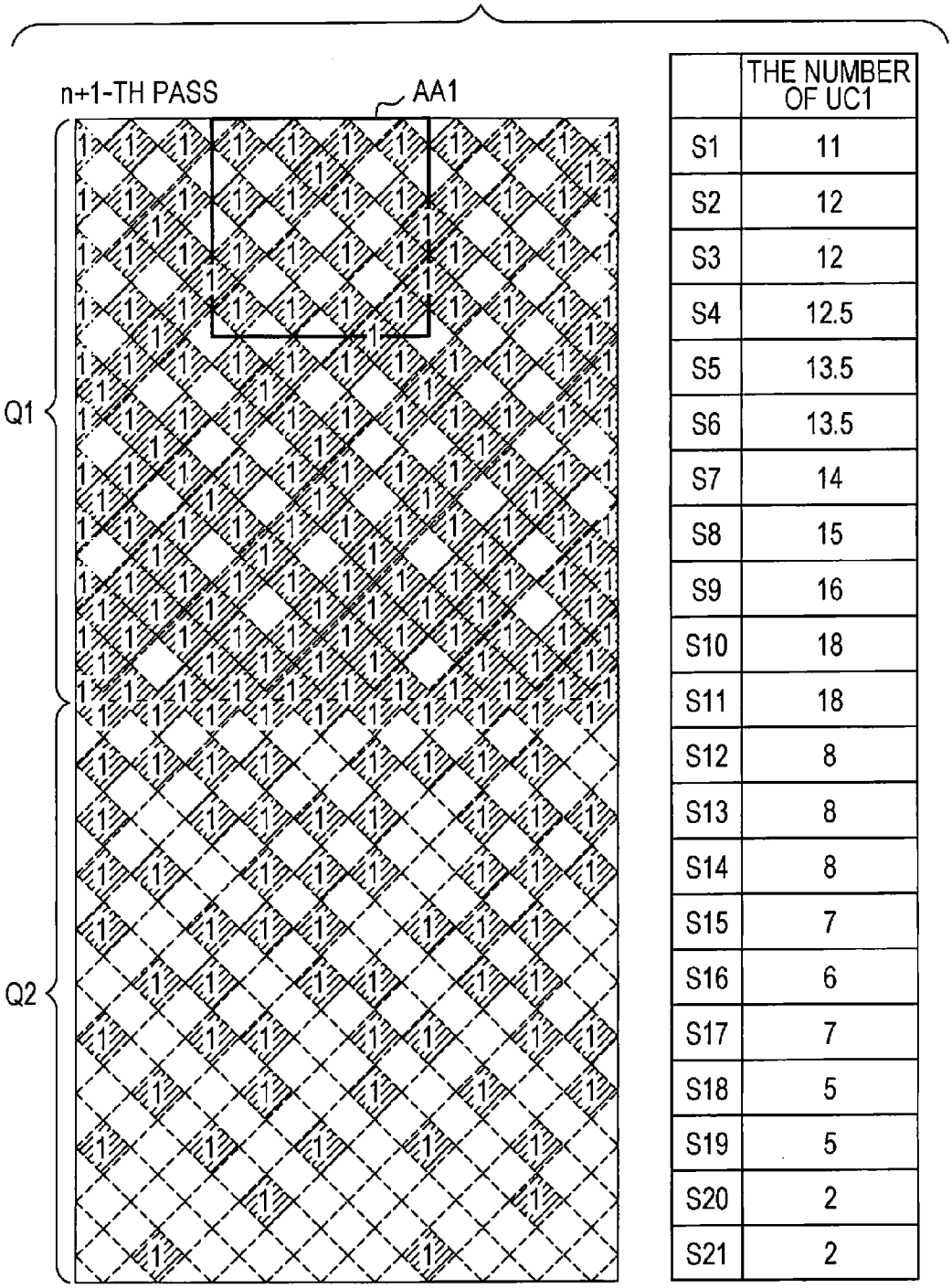
FIG. 6 is a diagram illustrating regions that are recorded in an n+1-th pass in regions Q1 and Q2.

FIG. 6 is a diagram illustrating a region which is recorded in an n+1-th pass in regions Q1 and Q2, and is a schematic diagram illustrating the entire region including both FIG. 4 and FIG. 5. Meanwhile, this drawing is the same as a mask which is used for dot recording of the n+1-th pass. Meanwhile, the term "mask" used herein is pixel data separately indicating a pixel which is a target for dot recording in the pass and a pixel which is not a target for dot recording. In FIG. 6, a unit super cell recorded in the n+1-th pass is referred to as a unit super cell UC1. Each unit super cell UC1 is hatched, and the number "1" is written therein. Meanwhile, a region which is not hatched in the region Q1 is partitioned with a unit super cell as a unit, and dots are recorded therein in an n-th pass. In addition, a region which is not hatched in the region Q2 is partitioned with a unit super cell as a unit, and dots are recorded therein in an n+2-th pass. In this manner, in each pass, dots are recorded in a region partitioned with a unit super cell as a unit. Meanwhile, a much larger mass of dots illustrated in FIG. 4 is formed by connecting a plurality of unit super cells to each other, and it can be said that dots are recorded in a region partitioned with a unit super cell as a unit. In this specification, a region in which two or more unit super cells are connected to each other and which is designated so as to be able to perform dot recording by one pass is referred to as a "connection super cell".

On the right side of FIG. 6, the regions Q1 and Q2 are divided into bands S1 to S21 for each width of a predetermined number of dots in the sub-scanning direction, and the number of unit super cells UC1 in each band is written. In the example illustrated in FIG. 6, the width of each band in the sub-scanning direction is six pixels when counted using FIGS. 4 and 5. Meanwhile, in a portion including half of the unit super cell UC1 in each band, the number of unit super cells UC1 is counted by setting half of the unit super cell UC1 as 0.5 pieces. In the region Q1, the number of unit super cells UC1 is eleven in the band S1 at the upper end portion of the nozzle array 95, and the number of unit super cells is eighteen in the band S11 at the center portion thereof. The number of unit super cells UC1 increases from the end portion to the center portion. In the region Q2, the number of unit super cells UC1 is eighteen in the band S11 at the center portion of the nozzle array 95, and the number of unit super cells is two in the band S21 at the lower end portion of the nozzle array 95. The number of unit super cells UC1 decreases from the center portion to the end portion. In the n+1-th pass, the number of unit super cells UC1 recorded by m nozzles (six nozzles in the present embodiment) at the end portion of the nozzle array 95 of the recording head 90 is smaller than the number of unit super cells UC1 recorded by m nozzles at the center portion of the recording head. Here, it is preferable to use a value equivalent to, for example, the height (length in the sub-scanning direction) of one unit super cell as an integer m. Meanwhile, in the bands S16 and S17, the number of unit super cells UC1 is reversed. This is because ranges (horizontal widths) of the regions illustrated in FIGS. 4 to 6 are narrow, and the numbers of unit super cells UC1 of both the bands are the same when a sufficiently wide range is taken. Meanwhile, it is preferable that the number of unit super cells increases gradually from the end portion to the center portion, but the number of unit super cells UC1 may be reversed in some bands that are not positioned at either the end portion or the center portion.

Figure 7:
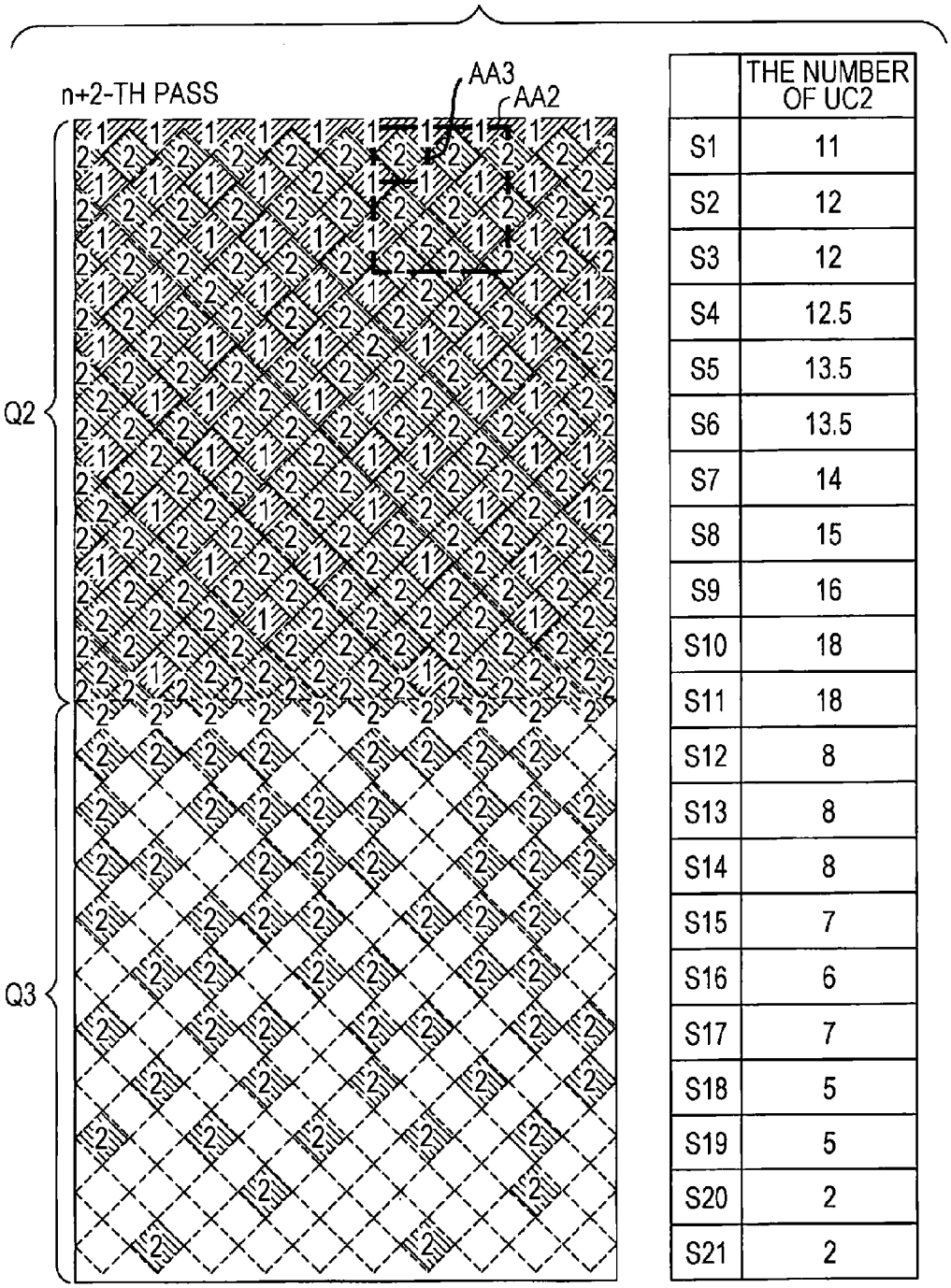
FIG. 7 is a diagram illustrating regions that are recorded in an n+1-th pass and an n+2-th pass in regions Q2 and Q3.

FIG. 7 is a diagram illustrating regions that are recorded in an n+1-th pass and an n+2-th pass in the regions Q2 and Q3 of FIG. 3. In the region which is recorded in the n+1-th pass, each unit super cell UC1 is hatched in the same manner as FIG. 6, and the number "1" is written therein. In FIG. 7, a unit super cell recorded in the n+2-th pass is referred to as a unit super cell UC2. The unit super cell UC2 is hatched, and the number "2" is written therein. Similarly to FIG. 6, also in FIG. 7, the regions Q2 and Q3 are divided into bands S1 to S21 for each width of a predetermined number of dots in the sub-scanning direction, and the number of unit super cells UC2 in each band is written. In the region Q2, the number of unit super cells UC2 is eleven in the band S1 at the upper end portion of the nozzle array 95, and the number of unit super cells is eighteen in the band S11 at the center portion thereof. The number of unit super cells UC2 increases from the end portion to the center portion. In the region Q3, the number of unit super cells UC2 is eighteen in the band S11 at the center portion of the nozzle array 95, and the number of unit super cells is two in the band S21 at the lower end portion of the nozzle array 95. The number of unit super cells UC2 decreases from the center portion to the end portion. Similarly, in the n+2-th pass, the number of unit super cells UC2 recorded by m nozzles (six nozzles in the present embodiment) at the end portion of the nozzle array 95 of the recording head 90 is smaller than the number of unit super cells UC2 recorded by m nozzles at the center portion of the recording head.

Figure 8A:
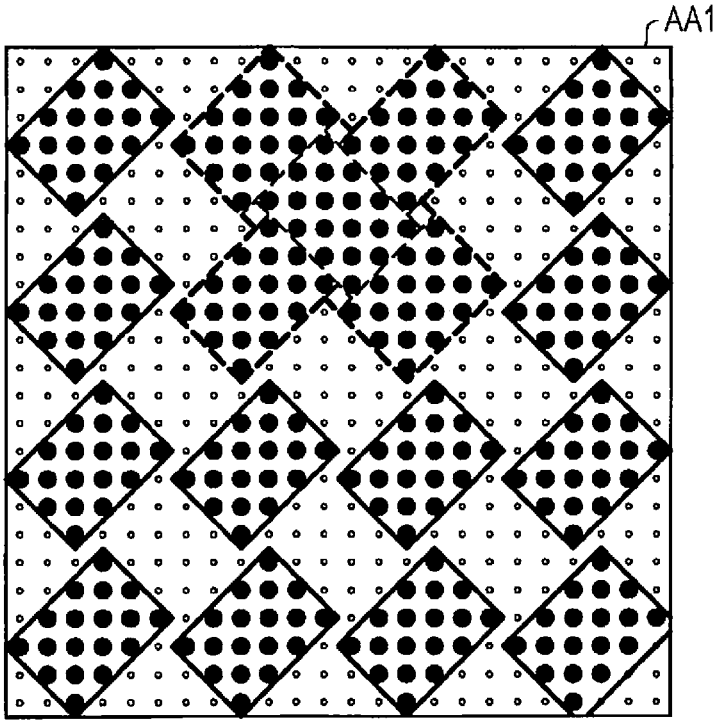
FIGS. 8A and 8B are diagrams illustrating a relationship between super cell regions, unit super cells, and connection super cells.
Figure 8B:
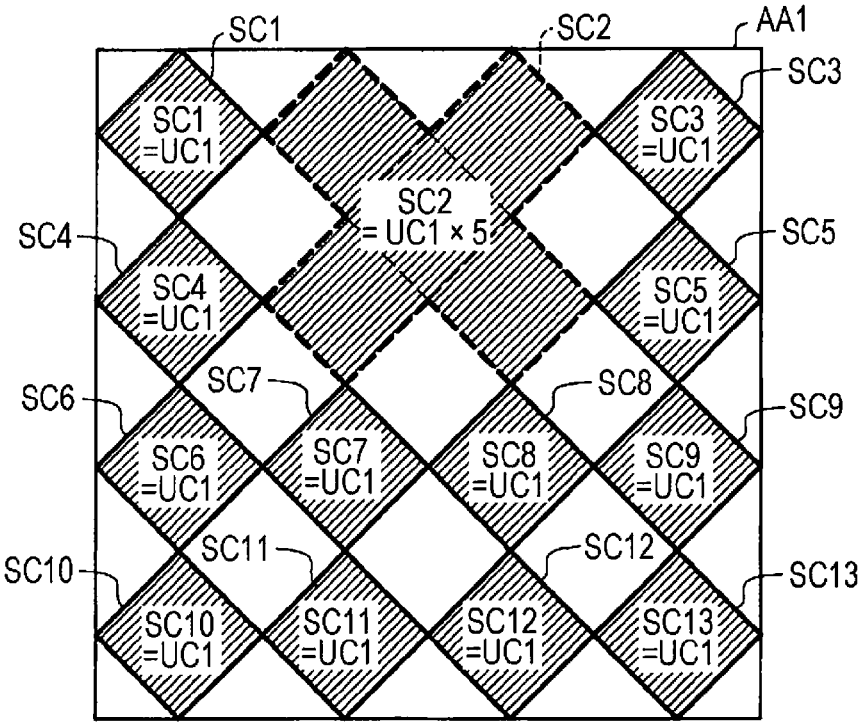

FIGS. 8A and 8B are diagrams illustrating a relationship between super cell regions, unit super cells, and connection super cells. The phrase "super cell region" used herein means a region constituted by a large number of pixels that are formed by one pass. The large number of pixels forms a dot group of one mass. A relationship between super cell regions, unit super cells, and connection super cells will be described below. FIG. 8A illustrates pixels within a region AA1 of FIG. 6. A black circle indicates a pixel which is a target for dot recording, and a small white circle indicates a pixel which is not a target for dot recording. FIG. 8B is a diagram illustrating FIG. 8A using unit super cells and connection super cells, and the contour thereof is slightly simplified. In the present embodiment, the region AA1 includes twelve super cell regions SC1 and SC3 to SC13 surrounded by a solid line, and one super cell region SC2 surrounded by a dashed line. Each of the super cell regions SC1 and SC3 to SC13 has the same size and shape as those of the unit super cell UC1. On the other hand, the super cell region SC2 is a connection super cell having five unit super cells UC1 that are connected to each other so as to be adjacent to each other. Meanwhile, as seen from FIG. 8A, the central cell of the super cell region SC2 has a shape in which the other four unit super cells UC1 are rotated by 90 degrees, but is similarly referred to as a unit super cell UC1. In this manner, the super cell region is divided into a plurality of types of the smallest super cell region and larger connection super cells. The smallest super cell region has the same size and shape as those of the unit super cell UC1. On the other hand, the larger connection super cells include a plurality of unit super cells UC1 (also includes symmetrical unit super cells). Meanwhile, the super cell region SC2 (connection super cell) including a plurality of unit super cells UC1 can be easily formed by disposing the unit super cells UC1 while shifting the unit super cells in horizontal and vertical directions by half of the size of the unit super cell. When a dot pattern, arrangement coordinates, and a lateral direction of the unit super cell UC1 are determined at the time of forming a mask pattern including a plurality of types of super cell regions, it is possible to easily form the super cell region and the mask pattern. Accordingly, it is possible to reduce the amount of memory used for forming the mask pattern.

The pixel regions of the white circles of FIG. 8A are regions in which dots are recorded in an n-th pass, and each of the pixel regions is a super cell region. In order to distinguish between an n+1-th pass and an n-th pass, a super cell region which is recorded in the n+1-th pass is referred to as a first super cell region, and a super cell region which is recorded in the n-th pass is referred to as a second super cell region. Meanwhile, in the range illustrated in FIGS. 8A and 8B, the second super cell region has the same size and shape as those of a unit super cell.

The first super cell region and the second super cell region come into contact with each other at mutual boundary lines, and do not have portions that mutually overlap each other. In addition, the boundary lines between the first super cell region and the second super cell region are not parallel to each other in either the main scanning direction or the sub-scanning direction. Thereby, banding or a joint stripe which is parallel to the main scanning direction and banding or a joint stripe which is parallel to the sub-scanning direction are not likely to be generated, and thus it is possible to make banding or a joint stripe less likely to be conspicuous in the entire image. Meanwhile, the phrase "super cell region" used herein refers to a region constituted by a large number of pixels. Being referred to as a "super cell region" means a region constituted by only one unit super cell and a region (connection super cell) including a plurality of unit super cells connected to each other. Since the connection super cell is a cell formed by connecting a plurality of (two or more) unit super cells to each other, it may be said that the super cell region includes one or more unit super cells.

Meanwhile, it is preferable that the boundary lines of the first super cell region and the second super cell region are constituted by a boundary line portion which is parallel to a straight line connecting center points of pixels (outermost peripheral pixels) present at the outermost periphery of the first super cell region and which is drawn between the outermost peripheral pixels and other pixels that are present on the outer side thereof. The same is true of the second super cell region. On the other hand, in many cases, boundary lines between pixels are usually recognized as being formed in a lattice shape. When such boundary lines between pixels are used as boundary lines between the first super cell region and the second super cell region as they are, the shapes of the boundary lines are complicated, and thus the shapes of the first super cell region and the second super cell region are not likely to be recognized. Therefore, it is preferable that the above-mentioned definition is used as the boundary lines between the first super cell region and the second super cell region.

As described above, according to the first embodiment, in each main scanning pass, dot recording is performed with a super cell region (unit super cell, and a connection super cell including one or more unit super cells UC1 and having boundary line portions which are not parallel to either the main scanning direction or the sub-scanning direction) as a unit, and thus it is possible to make banding or a joint stripe less likely to be conspicuous, as compared to a case where a boundary line between two super cell regions is constituted by only a boundary line parallel to the main scanning direction and a boundary line parallel to the sub-scanning direction. In addition, in the same main scanning, the number of unit super cells UC1 recorded by m nozzles (m is an integer of 2 or greater) at the end portion of the nozzle array 95 is smaller than the number of unit super cells UC1 recorded by m nozzles at the center portion of the nozzle array 95, and thus it is possible to reduce the number of boundaries of super cell regions as compared to a case where the numbers of unit super cells UC1 recorded by m nozzles are equal to each other over the whole length of the nozzle array 95, and to make a joint stripe less likely to be conspicuous.

Second Embodiment

Figure 9:
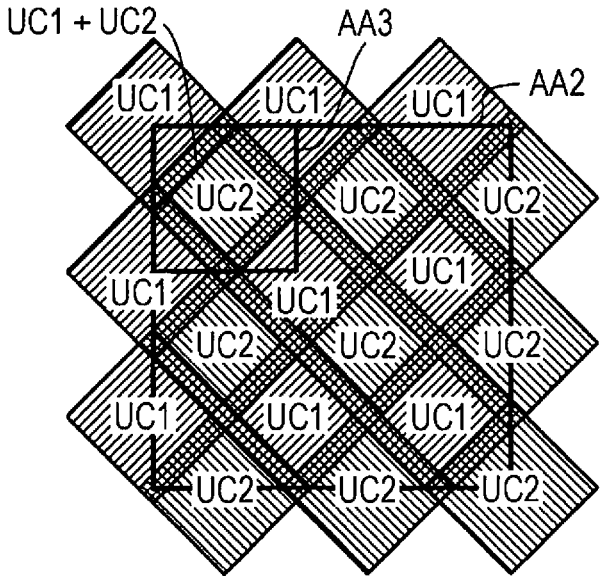
FIG. 9 is a diagram illustrating the arrangement of unit super cells in a second embodiment.

FIG. 9 is a diagram illustrating the arrangement of unit super cells in a second embodiment. FIG. 9 illustrates the arrangement of unit super cells UC1 and UC2 in a region AA2 of FIG. 7. However, the present embodiment is different from the first embodiment in that two unit super cells UC1 and UC2 partially overlap each other.

Figure 10:
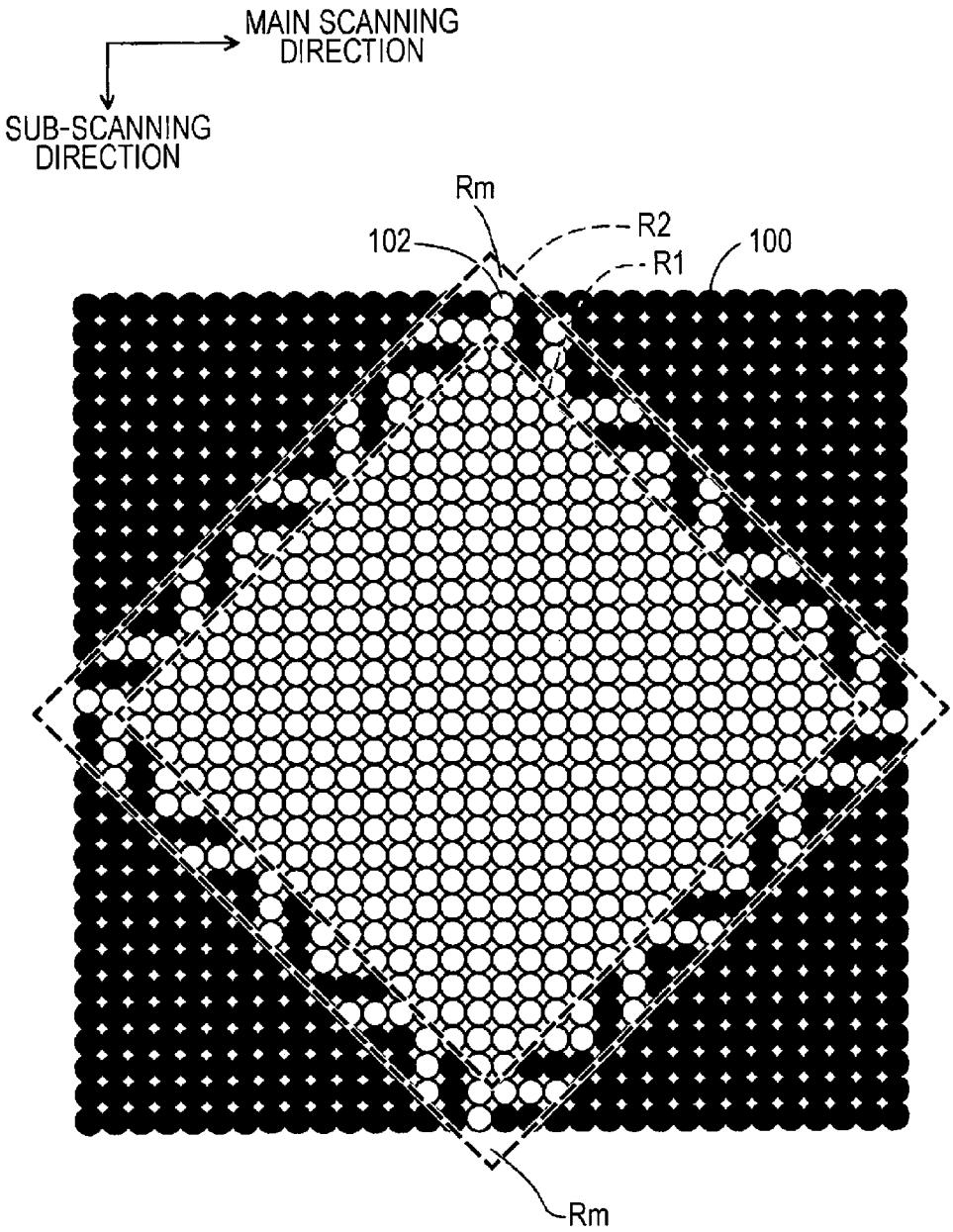
FIG. 10 is an enlarged view of a dot pattern in a region AA3 of FIG. 9.

FIG. 10 is an enlarged view of a dot pattern in a region AA3 of FIG. 9. Here, in order to simplify a rate of gradation (to be described later) in a boundary between the unit super cells UC1 and UC2, the region AA3 is shown by 32 dots×32 dots. A black circle 100 indicates a pixel position (pixel position at which dot recording is performed in an n+1-th pass) which is included in a first unit super cell UC1, and a white circle 102 indicates a pixel position (pixel position at which dot recording is performed in an n+2-th pass) which is included in a unit super cell UC2. In FIG. 10, a first dashed line R1 indicates a boundary line (contour line) of the first unit super cell UC1. That is, the pixel position at which dot recording is performed in the n+1-th pass is included in the boundary line R1. In the same meaning, a second dashed line R2 also indicates a boundary line (contour line) of the second unit super cell UC2. Except for the lower right side, all of the pixel positions that are located further outside than the dashed line R2 are the black circles 100, and all of the pixel positions that are located further inside than the dashed line R1 are the white circles 102. An intermediate region Rm between the dashed line R1 and the dashed line R2 is a region in which the first unit super cell UC1 and the second unit super cell UC2 overlap each other and the black circles 100 and the white circles 102 are mixed. Meanwhile, as can be understood from the above description, in the second embodiment, the boundary line R1 of the first unit super cell UC1 and the boundary line R2 of the second unit super cell UC2 are located at different positions. In the present embodiment, in the intermediate region Rm (region in which two unit super cells UC1 and UC2 partially overlap each other) in which the black circles 100 and the white circles 102 are mixed, dot recording is completed by two passes. It is possible to make banding less likely to be conspicuous by providing such an intermediate region Rm. Here, a description is given by taking an example of a boundary between two unit super cells, but the same is true of boundaries of a unit super cell and a connection super cell and boundaries of two connection super cells.

In the present embodiment, the inside of the intermediate region Rm is further divided into a plurality of (specifically, three) layered regions. That is, in the layered region immediately inside the dashed line R2, a ratio of the black circles 100 to the white circles 102 is 2:1. In the intermediate layered region between the dashed line R1 and the dashed line R2, a ratio of the black circles 100 to the white circles 102 is 1:1. In the layered region immediately outside the dashed line R1, a ratio of the black circles 100 to the white circles 102 is 1:2. In this manner, in the intermediate region Rm in which two unit super cells UC1 and UC2 overlap each other, a ratio of the black circles 100 to the white circles 102 may be configured to change in a stepwise manner. Thereby, it is possible to make banding less likely to be conspicuous. In this manner, in the intermediate region Rm, a configuration in which a ratio of the number of pixel positions at which dot recording is performed in an odd-numbered pass to the number of pixel positions at which dot recording is performed in an even-numbered pass gradually changes from one super cell region toward the other super cell region is also referred to as "gradation having a ratio in charge of dot recording". Here, the phrase "ratio in charge of dot recording" used herein means a ratio of the number of pixel positions at which dot recording is performed in an odd-numbered pass to the number of pixel positions at which dot recording is performed in an even-numbered pass.

It is preferable that the intermediate region Rm between the two unit super cells UC1 and UC2 does not include either a set of black circles 100 of p×p pixels (p is an integer of 2 or greater) or a set of white circles 102 of p×p pixels. Here, 2, 3, 4, 5, or the like is preferable as the value of p. In this manner, the defining of the intermediate region Rm makes the range of the intermediate region Rm clearer. From the same meaning, it is preferable that the boundary line of the first unit super cell UC1 is defined so that the first unit super cell does not include a set of white circles 102 of p×p pixels (p is an integer of 2 or greater), and that the boundary line of the second super cell region UC2 is defined so that the second super cell region does not include a set of black circles 100 of p×p pixels.

As described above, according to the second embodiment, since the boundaries of the first unit super cell UC1 and the second unit super cell UC2 (boundaries of the first super cell region and the second super cell region) overlap each other, it is possible to make banding or a joint stripe less likely to be conspicuous. Further, in the intermediate region Rm between the boundaries of the first unit super cell UC1 and the second unit super cell UC2 (boundaries of the first super cell region and the second super cell region), a stepwise change in a ratio of the black circles 100 to the white circles 102 can make banding less likely to be conspicuous.

Third Embodiment

Figure 11:
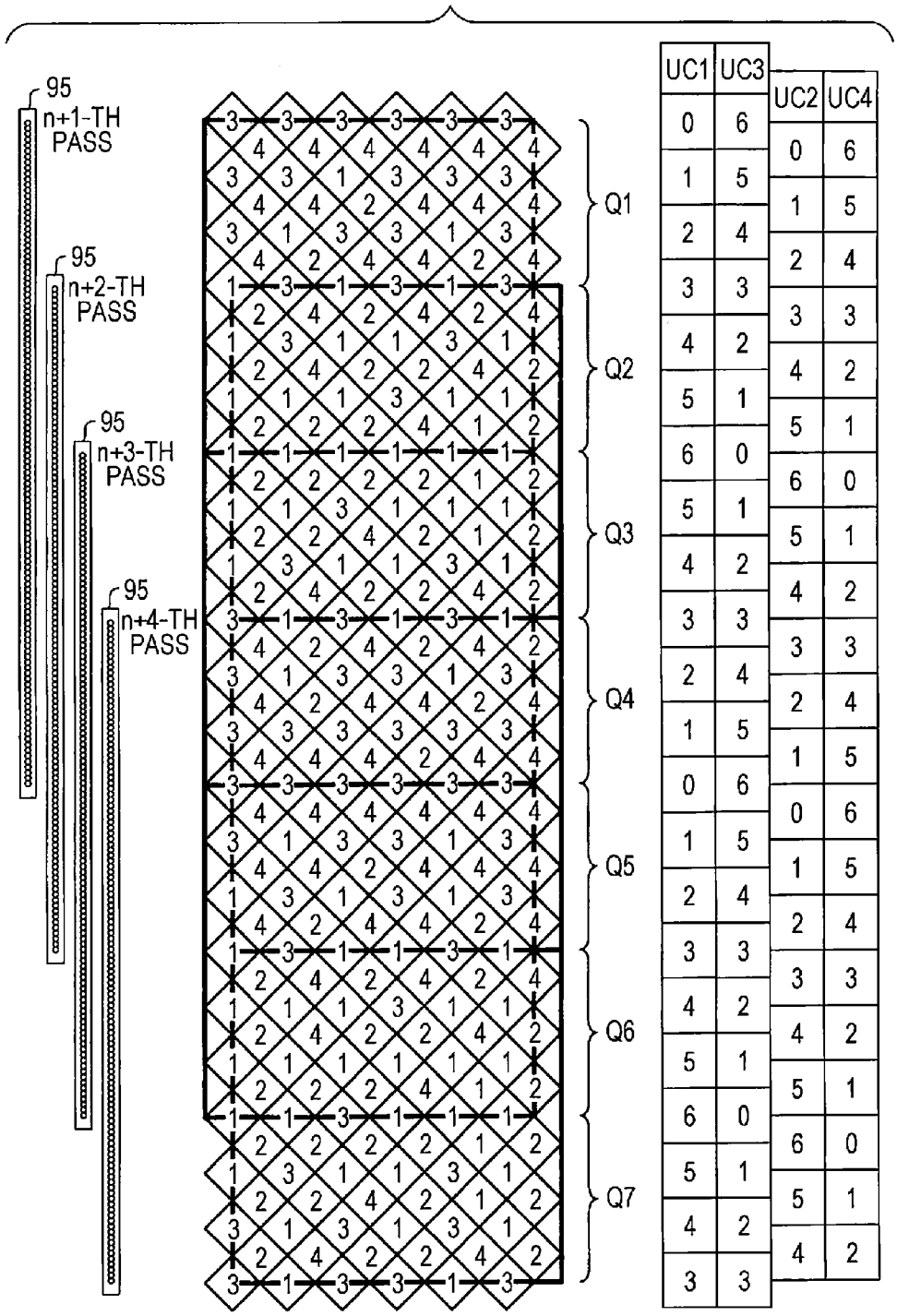
FIG. 11 is a diagram illustrating a third embodiment.

FIG. 11 is a diagram illustrating a third embodiment. In the third embodiment, the dot recording of a predetermined region is completed by four passes. The positions of nozzle arrays 95 in respective passes (n+1, n+2, n+3, and n+4) are shown on the left side of FIG. 11. Super cell regions recorded by the respective passes are written in the middle of FIG. 11. The number "1" indicates a super cell region which is recorded by the n+1-th pass, and the numbers "2", "3", and "4" indicate super cell regions that are recorded by the n+2-th, n+3-th, and n+4-th passes, respectively. Meanwhile, the shape and size of a super cell region which is recorded by each pass are the same as the shape and size of a unit super cell which is recorded by each pass. Similarly to FIGS. 6 and 7, the number of unit super cells in each band is written on the right side of FIG. 11.

In the n+1-th pass, dots of unit super cells UC1 are recorded in regions Q1 to Q4. Here, when the number of unit super cells UC1 which are recorded in the n+1-th pass is counted, the number of unit super cells is zero, in the band at the end portion of the nozzle array 95, and the number of unit super cells is six in the center portion (boundary between the regions Q2 and Q3) thereof. In the n+2-th pass, dots of unit super cells UC2 are recorded in the regions Q2 to Q5. Here, when the number of unit super cells UC2 which are recorded in the n+2-th pass is counted, the number of unit super cells is zero in the band at the end portion of the nozzle array 95, and the number of unit super cells is six in the center portion (boundary between the regions Q3 and Q4) thereof. Similarly to the number of n+3-th pass unit super cells UC3 and the number of n+4-th pass unit super cells UC4, the number of unit super cells is zero in the band at the end portion of the nozzle array 95, and the number of unit super cells is six in the center portion thereof. In this manner, also in multi-pass recording of four passes, the number of unit super cells recorded by m nozzles (m is an integer of 2 or greater) at the end portion of the nozzle array 95 can be made larger than the number of unit super cells recorded by m nozzles at the center portion of the nozzle array. In addition, in the case of multi-pass recording of two passes illustrated in FIG. 6, the number of unit super cells UC1 recorded in the region Q1 which is recorded in the rear end portion of the nozzle array 95 is larger than the number of unit super cells UC1 recorded in the region Q2 which is recorded in the front end portion of the nozzle array 95. On the other hand, in the case of multi-pass recording of four passes illustrated in FIG. 11, the number of unit super cells UC1 recorded in the region Q1 which is recorded in the rear end portion of the nozzle array 95 can be set to be the same as the number of unit super cells UC1 recorded in the region Q4 which is recorded in the front end portion of the nozzle array 95. In addition, the numbers of unit super cells UC1 recorded in the regions Q2 and Q3 which are recorded in the center portion of the nozzle array 95 can be set to be the same as each other. That is, it is possible to maximize the number of unit super cells in the center portion and to gradually decrease the number of unit super cells symmetrically toward the end, and thus the number of unit super cells disposed in the respective regions Q1 to Q4 can be well-balanced.

Fourth Embodiment

Figure 12A:
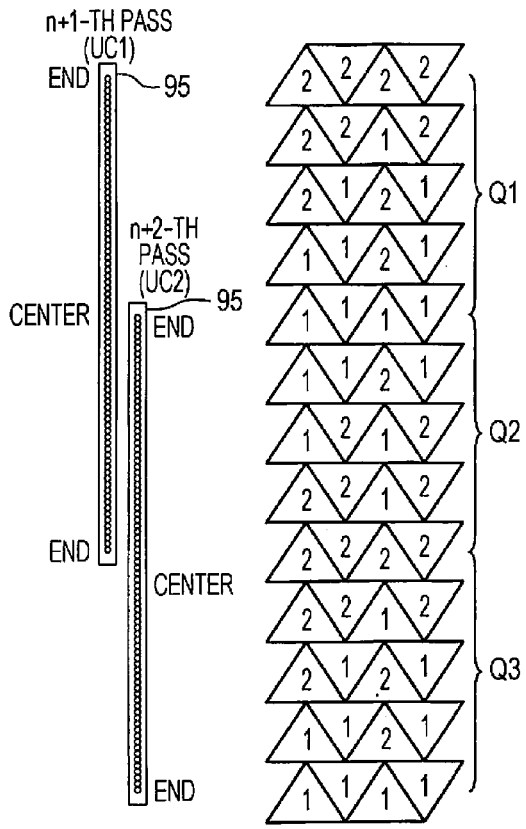
FIGS. 12A and 12B are diagrams illustrating a fourth embodiment.
Figure 12B:
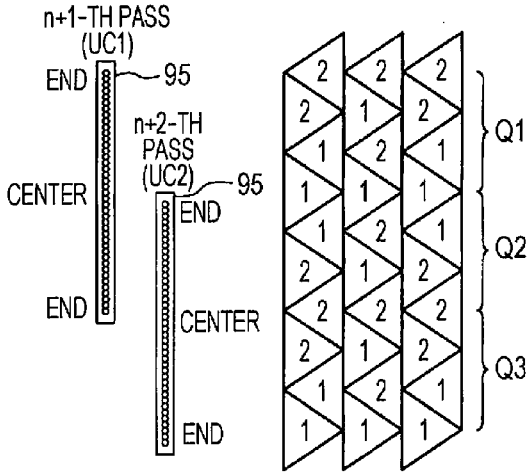

FIGS. 12A and 12B are diagrams illustrating a fourth embodiment. In a pattern of FIG. 12A, boundary lines of unit super cells UC1 and UC2 form a triangle. One of three sides of the triangle is parallel to a main scanning direction, but the other two sides are not parallel to either the main scanning direction or a sub-scanning direction. In FIG. 12A, the number of unit super cells UC1 that are recorded in an n+1-th pass is zero in regions S1 and S9 corresponding to an end portion of a nozzle array 95 and is four in a region S5 corresponding to a center portion of the nozzle array 95. In addition, the number of unit super cells UC2 that are recorded in an n+2-th pass is zero in regions S5 and S13 corresponding to an end portion of a nozzle array 95 and is four in a region S9 corresponding to a center portion of the nozzle array 95.

In a pattern of FIG. 12B, boundary lines of unit super cells UC1 and UC2 form a triangle. One of three sides of the triangle is parallel to a sub-scanning direction, but the other two sides are not parallel to either a main scanning direction or the sub-scanning direction. In FIG. 12B, the number of unit super cells UC1 that are recorded in an n+1-th pass is zero in regions S1 and S7 corresponding to an end portion of a nozzle array 95 and is three in a region S4 corresponding to a center portion of the nozzle array 95. In addition, the number of unit super cells UC2 that are recorded in an n+2-th pass is zero in regions S3 and S10 corresponding to an end portion of a nozzle array 95 and is three in a region S7 corresponding to a center portion of the nozzle array 95. In this manner, the unit super cell may have a triangular shape. In this manner, at least some of boundary lines of the individual unit super cells may have a boundary line portion which is not parallel to either the main scanning direction or the sub-scanning direction.

Fifth Embodiment

Figure 13:
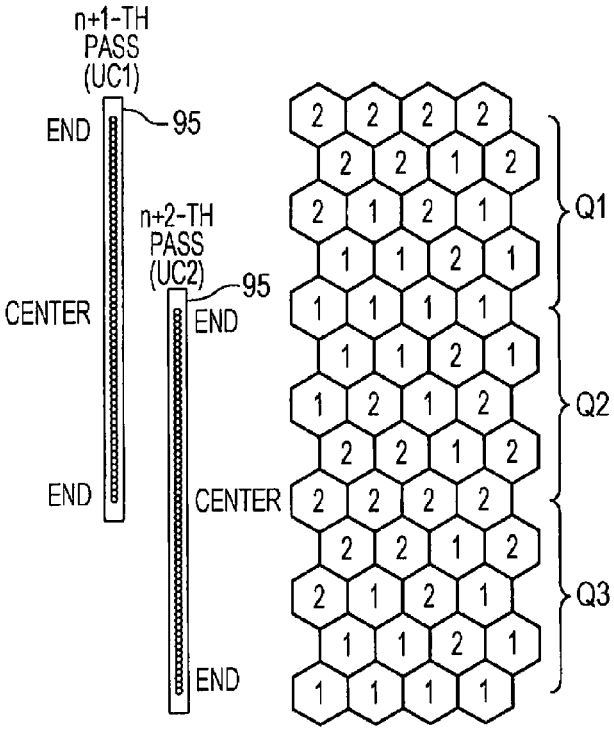
FIG. 13 is a diagram illustrating a fifth embodiment.

FIG. 13 is a diagram illustrating a fifth embodiment. Boundary lines of unit super cells UC1 and UC2 form a hexagon. Two of six sides of the hexagon are parallel to a sub-scanning direction, but the other four sides are not parallel to either a main scanning direction or the sub-scanning direction. Similarly, when the number of unit super cells in each band is counted, the number of unit super cells UC1 that are recorded in an n+1-th pass is zero in regions S1 and S9 corresponding to an end portion of a nozzle array 95 and is four in a region S5 corresponding to a center portion of the nozzle array 95. In addition, the number of unit super cells UC2 that are recorded in an n+2-th pass is zero in regions S5 and S13 corresponding to an end portion of a nozzle array 95 and is four in a region S9 corresponding to a center portion of the nozzle array 95. In the fifth embodiment illustrated in FIG. 13, a boundary line portion parallel to the main scanning direction or the sub-scanning direction does not constitute a long continuous straight line, unlike in the fourth embodiment illustrated in FIGS. 12A and 12B, and just appears intermittently, and thus banding is generated over a long distance and is not likely to be conspicuous. Considering the above-described embodiments, it is preferable that all of a plurality of unit super cells have the same polygonal shape. The phrase "the same polygonal shape" used herein includes a symmetric shape such as rotational symmetry or mirror symmetry.

Modification Example

Although embodiments of the invention have been described so far based on several embodiments, these embodiments are given not for limiting the invention but only for easy understanding of the invention. Various modifications and improvements may be made without departing from the scope and spirit of the invention, and equivalents thereof are thus encompassed by the invention.

Modification Example 1

In the above-described embodiments, super cell regions (unit super cell and connection super cell) have a polygonal shape. However, various other shapes can be adopted as the shape of the super cell region. For example, a boomerang shape, an arabesque shape, or a fractal shape may be used. For example, the boomerang shape can be formed by combining three unit super cells UC1 of the center, upper light, and upper left unit super cells in five unit super cells UC1 constituting the super cell region SC2 illustrated in FIG. 8B (or a total of three unit super cells UC1 of the center, upper light, and lower right unit super cells).

Modification Example 2

In the above-described embodiments, although the number of passes N of multi-pass recording is two of 2 and 4, any integer of 2 or greater can be used as the number of passes N. In addition, a dot proportion in each main scanning pass can be set to any value as long as the sum of dot proportions on the main scanning lines based on N main scanning passes is set to 100%. In addition, it is preferable that positions of pixels in charge in N main scanning passes do not overlap each other. Meanwhile, in general, it is preferable that a feeding amount of sub-scanning performed after the termination of one main scanning pass is set to a fixed value which is equivalent to 1/N of a head height.

Modification Example 3

In addition, in the above-described embodiments, although it is described that a recording head moves in a main scanning direction, the invention is not limited to the above-mentioned configuration as long as ink can be ejected by relatively moving a recording medium and a recording head in a main scanning direction. For example, the recording medium may move in the main scanning direction in a state where the recording head is stopped, or both the recording medium and the recording head may move in the main scanning direction. Meanwhile, the recording medium and the recording head may also relatively move in a sub-scanning direction. For example, as in a flat head type printer, a head portion may move in an XY direction with respect to a recording medium mounted (fixed) on a table and may perform recording. That is, a configuration may also be adopted in which the recording medium and the recording head can move relatively in at least one of the main scanning direction and the sub-scanning direction.

Modification Example 4

In the above-described embodiments, a printer that ejects ink onto a printing sheet has been described. However, the invention can also be applied to various other dot recording apparatuses and can also be applied to, for example, an apparatus that forms dots by ejecting droplets onto a substrate. Further, a liquid ejecting apparatus that ejects or discharges a liquid other than ink may be adopted, and the invention can be applied to various liquid ejecting apparatuses that include a liquid ejecting head for ejecting a small amount of droplets. Meanwhile, the term "droplet" used herein refers to the state of a liquid to be ejected from the liquid ejecting apparatus, and includes a granular shape, a teardrop shape, and a tailed threadlike shape. In addition, the term "liquid" used herein may be a material that can be ejected from the liquid ejecting apparatus. For example, a material of a liquid phase is preferably used. A fluid state material, such as a liquid state material having high or low viscosity, sol, gel water, an inorganic solvent, an organic solvent, a solution, a liquid resin, or a liquid metal (metal melt), may be used. In addition to a liquid as one state of a material, a material, which is obtained by dissolving, dispersing, or mixing particles of function material containing solid material, such as pigment or metal particles, in a solvent, may be used. In addition, representative examples of the liquid include ink described in the above-described embodiments, liquid crystal, and the like. The term "ink" used herein includes various liquid compositions, such as aqueous ink, oil-based ink, gel ink, and hot-melt ink. Specific examples of the liquid ejecting apparatus include a liquid ejecting apparatus that ejects a liquid, in which a material, such as an electrode material or a color material, is dispersed or dissolved, and is used in manufacturing a liquid crystal display, an electroluminescence (EL) display, a field emission display, and color filters, a liquid ejecting apparatus that ejects a bioorganic material to be used in manufacturing a bio-chip, a liquid ejecting apparatus that ejects a liquid, serving as a sample, as a precision pipette, a textile printing apparatus, and a micro dispenser. In addition, a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, and a liquid ejecting apparatus that ejects an etchant, such as acid or alkali, to etch a substrate may be used. The invention may be applied to one of the liquid ejecting apparatuses.

What is claimed is:

1. A dot recording apparatus comprising:

a recording head that includes a plurality of nozzles;

a main scanning driving mechanism that performs a main scanning pass for forming dots on a recording medium while relatively moving the recording head and the recording medium in a main scanning direction;

a sub-scanning driving mechanism that performs sub-scanning for relatively moving the recording medium and the recording head in a sub-scanning direction that intersects the main scanning direction; and a control unit, wherein the control unit performs multi-pass recording in which dot recording on a main scanning line is completed by N main scanning passes (N is a predetermined integer of 2 or greater), wherein in dot recording in each main scanning pass, the dot recording is performed with a super cell region, having a boundary line portion which is not parallel to either the main scanning direction or the sub-scanning direction in at least a portion of a boundary line between the super cell region and another super cell region, as a unit, the super cell region including one or more unit super cells formed as a dot group of one mass by some of the plurality of nozzles, and wherein in the same main scanning pass, the number of unit super cells recorded by m nozzles (m is an integer of 2 or greater) at an end portion of the recording head is smaller than the number of unit super cells recorded by m nozzles at a center portion of the recording head.

2. The dot recording apparatus according to claim 1, wherein the unit super cells have the same polygonal shape.

3. The dot recording apparatus according to claim 2, wherein in dot recording in each main scanning pass, some of the plurality of unit super cells recorded in the same main scanning pass are connected to other unit super cells recorded in the same main scanning pass to thereby generate a connection super cell, and wherein the super cell region is either the unit super cell or the connection super cell.

4. The dot recording apparatus according to claim 1, wherein the super cell regions include a first super cell region and a second super cell region that overlap each other in mutual boundaries.

5. The dot recording apparatus according to claim 4, wherein when the first super cell region is recorded by a first main scanning pass and the second super cell region is recorded by a second main scanning pass which is subsequent to the first main scanning pass, a ratio in charge of dot recording which is a ratio of the number of pixel positions at which dot recording is performed, as pixel positions belonging to the first super cell region, to the number of pixel positions at which dot recording is performed, as pixel positions belonging to the second super cell region, is set to gradually change from the first super cell region toward the second super cell region, in an intermediate region in which the first super cell region and the second super cell region overlap each other.

6. The dot recording apparatus according to claim 1, wherein when a boundary line of any of the individual super cell regions includes a portion which is parallel to either the main scanning direction or the sub-scanning direction, the parallel portion appears intermittently without continuing on the recording medium.

7. The dot recording apparatus according to claim 1, wherein a value of the N is 4.

8. The dot recording apparatus according to claim 7, wherein the super cell regions have the same shape.

9. A dot recording method comprising:

performing a main scanning pass for forming dots on a recording medium while relatively moving the recording medium and a recording head that includes a plurality of nozzles in a main scanning direction; and performing multi-pass recording in which formation of dots on a main scanning line is completed by N main scanning passes (N is a predetermined integer of 2 or greater), wherein in dot recording in each main scanning pass, the dot recording is performed with a super cell region, having a boundary line portion which is not parallel to either the main scanning direction or a sub-scanning direction that intersects the main scanning direction in at least a portion of a boundary line between the super cell region and another super cell region, as a unit, the super cell region including one or more unit super cells formed as a dot group of one mass by some of the plurality of nozzles, and wherein in a range of the same main scanning pass, the number of unit super cells recorded by m nozzles (m is an integer of 2 or greater) at an end portion of the recording head is smaller than the number of unit super cells recorded by m nozzles at a center portion of the recording head.

10. A non-transitory computer readable storage medium storing a computer program, the computer program for realizing a function of creating raster data for causing a dot recording apparatus to perform dot recording, the dot recording apparatus performing a main scanning pass for forming dots on a recording medium while relatively moving the recording medium and a recording head that includes a plurality of nozzles in a main scanning direction, and performing multi-pass recording in which formation of dots on a main scanning line is completed by N main scanning passes (N is a predetermined integer of 2 or greater), wherein the raster data is raster data for recording dots with a super cell region, having a boundary line portion which is not parallel to either the main scanning direction or the sub-scanning direction intersecting the main scanning direction in at least a portion of a boundary line between the super cell region and another super cell region, as a unit, the super cell region including one or more unit super cells formed as a dot group of one mass by some of the plurality of nozzles, and wherein in a range of the same main scanning pass, the number of unit super cells recorded by m nozzles (m is an integer of 2 or greater) at an end portion of the recording head is smaller than the number of unit super cells recorded by m nozzles at a center portion of the recording head.

* * * * *